US007758136B2

(12) United States Patent
Kachi

(10) Patent No.: US 7,758,136 B2
(45) Date of Patent: Jul. 20, 2010

(54) INK SUPPLY DEVICE FOR INKJET PRINTER

(75) Inventor: Yasuhiko Kachi, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 319 days.

(21) Appl. No.: 11/092,597

(22) Filed: Mar. 29, 2005

(65) Prior Publication Data

US 2005/0219282 A1 Oct. 6, 2005

(30) Foreign Application Priority Data

Mar. 30, 2004 (JP) ..... 2004-100902

(51) Int. Cl.
*B41J 29/38* (2006.01)
*B41J 29/393* (2006.01)
*B41J 2/175* (2006.01)

(52) U.S. Cl. ..... 347/6; 347/19; 347/85

(58) Field of Classification Search ..... 347/30, 347/6, 19, 85
See application file for complete search history.

(56) References Cited

U.S. PATENT DOCUMENTS

2003/0202053 A1* 10/2003 Hawkins et al. ..... 347/77
2004/0114011 A1* 6/2004 Matsushita et al. ..... 347/92
2005/0168520 A1* 8/2005 Mantooth et al. ..... 347/30

FOREIGN PATENT DOCUMENTS

| | | | | |
|---|---|---|---|---|
| JP | 3-295661 | A | | 12/1991 |
| JP | 8-156280 | A | | 6/1996 |
| JP | 08156280 | A | * | 6/1996 |
| JP | 11-84938 | A | | 3/1999 |
| JP | 2001-242741 | A | | 9/2001 |
| JP | 2002-116658 | A | | 4/2002 |
| JP | 2002116658 | A | * | 4/2002 |
| JP | 2003-127417 | A | | 5/2003 |
| JP | 2003-145790 | A | | 5/2003 |
| JP | 2003145790 | A | * | 5/2003 |

* cited by examiner

*Primary Examiner*—Matthew Luu
*Assistant Examiner*—Jannelle M Lebron
(74) *Attorney, Agent, or Firm*—Birch, Stewart, Kolasch & Birch, LLP

(57) ABSTRACT

The ink supply device for an inkjet printer which supplies ink to an inkjet head via an ink supply channel from an ink tank storing ink, the ink supply device comprises: a printing duty pre-reading device which previously reads a printing duty from print data; and a flow rate adjustment device which is provided on an upstream side of a pressure loss region in the ink supply channel and controls a flow rate of ink passing through the pressure loss region in the ink supply channel to a prescribed flow rate, in accordance with the printing duty obtained by the printing duty pre-reading device.

5 Claims, 6 Drawing Sheets

INK SUPPLY DEVICE FOR INKJET PRINTER

BACKGROUND OF THE INVENTION

1. Field of the Invention

The present invention relates to an ink supply device for an inkjet printer, and more particularly, to an ink supply device for an inkjet printer which provides a stable ink supply by accurately controlling pressure loss in an ink supply channel for supplying ink to an inkjet head, through controlling the temperature and pressure of the ink.

2. Description of the Related Art

Conventionally, an inkjet printer is known as an image recording apparatus, which comprises an inkjet head having an arrangement of a plurality of nozzles and which records images on a recording medium by discharging ink from the nozzles toward the recording medium while causing the inkjet head and the recording medium to move relatively to each other.

In an inkjet head of this kind, ink is supplied to pressure chambers from an ink tank, via an ink supply channel, and by deforming piezoelectric elements by supplying electrical signals corresponding to the image data to the piezoelectric elements, the diaphragms constituting a portion of each pressure chamber are caused to deform, thereby reducing the volume of the pressure chamber and causing the ink inside the pressure chamber to be discharged from a nozzle in the form of a droplet.

In this case, when supplying ink from an ink tank storing ink to the pressure chambers, via an ink supply channel, pressure loss occurs in the ink at the filter provided in the ink supply channel to remove foreign matter from the ink, and at the joint sections or elbows of the ink supply channel. If the ink pressure is reduced significantly, then there is a risk that ink may not be discharged suitably from the nozzles.

In particular, if high-viscosity ink is discharged continuously at a high printing duty, then the viscous resistance of the ink supply channel increases in regions such as the filter section, and large pressure loss is caused by this viscous resistance. Therefore, the internal pressure of the head is reduced, the size of the discharged ink droplets decreases, and the density of the recorded image declines. In the worst case scenario, a discharge error occurs.

Therefore, it is necessary to provide an ink supply having a stable pressure, and in the prior art, various proposals have been made in order to achieve stable ink supply and stable ink discharge.

For example, technology is known in which a temperature adjustment device is provided which adjusts the temperature partially in a prescribed portion of the ink supply channel only, such as the filter member provided in the ink supply channel, in order to maintain uniform ink discharge volume and discharge frequency (see, for example, Japanese Patent Application Publication No. 8-156280). In this way, it is possible to stabilize the negative pressure inside the ink tank in accordance with the ink characteristics, and to reduce the viscous resistance of the ink in the ink supply channel (and especially in the filter section) during high-duty printing, thereby preventing increased pressure loss in the filter section due to increased ink viscous resistance. Therefore, the discharge characteristics can be stabilized, even when operating at high duty.

Furthermore, technology is also known in which a heating device capable of heating the region of the filter is interposed in the ink channel, thereby heating the ink passing through the filter and reducing the viscosity of the ink (see, for example, Japanese Patent Application Publication No. 3-295661). Consequently, the fluid resistance of the ink when passing through the filter is reduced, thereby preventing blockages even if the ink discharge ports are extremely fine, while also increasing the speed of ink replenishment to the ink discharge ports.

Moreover, technology is also known which comprises: a recording head which discharges high-viscosity ink that has been reduced to low viscosity by raising the temperature thereof, the ink being discharged while it is in a low-viscosity state, a temperature determination device which determines the temperature of the high-viscosity ink, a supply channel heating device which heats the high-viscosity ink in the supply channel, and a heating control device which controls the supply channel heating device on the basis of the temperature determination device. Furthermore, the heating control device controls a tank heating device for heating the high-viscosity ink in the ink tank and a head heating device for heating the high-viscosity ink in the recording head in such a manner that the heating temperature of at least one of the tank heating device or the head heating device is high, thereby heating the high-viscosity ink inside the supply channel, reducing the ink to a low viscosity, and hence enabling the ink to be discharged in a stable fashion (see, for example, Japanese Patent Application Publication No. 2003-127417).

However, in the device described in Japanese Patent Application Publication No. 8-156280, the heating temperature is changed according to the printing duty in order to reduce power consumption, and the ink temperature is adjusted in three stages with respect to printing duty. Nevertheless, when printing with high-viscosity ink, it is necessary to control the ink temperature in a stepless fashion in accordance with the printing duty, but in the case of the three-stage control disclosed in the patent reference, it is not possible to achieve suitable control when discharging high-viscosity ink. Moreover, there is a further problem in terms of the responsiveness of temperature control, when the printing duty changes.

Moreover, Japanese Patent Application Publication No. 3-295661 discloses technology for reducing pressure loss by reducing the ink viscosity through heating the filter section, or the like. However, if the heating of the filter section is controlled in accordance with the head discharge frequency, in real time, it is not possible to adjust the ink temperature accurately, due to delay in the temperature control, and a problem arises in that a heater cannot be disposed on the upstream side of the filter section of the ink supply channel, for instance. Therefore, the ink temperature cannot be controlled effectively in an accurate manner.

Furthermore, in the device described in Japanese Patent Application Publication No. 2003-127417, if the ink temperature in the pressure loss region of an ink supply section is set to a higher temperature than the internal temperature of the head, which guarantees ink discharge properties (in other words, if the temperature of the pressure loss region>internal temperature of head), in order to reduce the viscous resistance in the ink supply section, then a problem arises in that the temperature inside the head cannot be controlled.

SUMMARY OF THE INVENTION

The present invention has been contrived in view of the foregoing circumstances, and an object thereof is to provide an ink supply device for an inkjet printer whereby pressure loss in the pressure loss region of the ink supply section is reduced, and stable ink supply control can be achieved when using a high-viscosity ink, even if the printing duty varies.

In order to attain the aforementioned object, the present invention is directed to an ink supply device for an inkjet printer which supplies ink to an inkjet head via an ink supply channel from an ink tank storing ink, the ink supply device comprising: a printing duty pre-reading device which previously reads a printing duty from print data; and a flow rate adjustment device which is provided on an upstream side of a pressure loss region in the ink supply channel and controls a flow rate of ink passing through the pressure loss region in the ink supply channel to a prescribed flow rate, in accordance with the printing duty obtained by the printing duty pre-reading device.

Accordingly, the print data, such as the image data to be recorded (printed) by the inkjet printer, is read out and the ink discharge volume and the printing duty are predicted. The ink flow is then controlled by controlling the pressure loss at the pressure loss region in such a manner that an ink flow corresponding to the predicted ink discharge volume and printing duty can be supplied to the inkjet head. Therefore, if the printing duty changes, it is possible to ensure the desired ink discharge volume at all times, and hence the ink discharge characteristics can be stabilized.

Preferably, the flow rate adjustment device comprises: an ink temperature adjustment device which controls the flow rate of the ink passing through the pressure loss region by adjusting temperature of the ink and thereby adjusting a viscosity of the ink; and a device which controls a temperature adjustment start timing to compensate temperature adjustment start timings for the ink between the ink temperature adjustment device and the pressure loss region.

In this way, by controlling the temperature adjustment of the ink with reference to temperature adjustment start timings for the ink temperature (namely, the ink temperature response time lag), it is possible to heat the ink in a stable fashion and hence reliable ink supply can be achieved, even in the case of high-viscosity ink.

Preferably, the ink supply device further comprises: an average flow calculation device which calculates an average flow of the ink at the pressure loss region in a prescribed time period, from volume of ink droplets to be discharged from the inkjet head as determined according to the printing data; and a temperature adjustment start timing calculation device which calculates the temperature adjustment start timing according to a pre-reading time differential set by the printing duty pre-reading device, an ink volume in the ink supply channel between the ink temperature adjustment device and the pressure loss region, and the average flow of the ink at the pressure loss region.

In this way, the ink flow and the flow velocity are predicted on the basis of the print data, such as the image data to be recorded by the inkjet printer, and by controlling the ink temperature and the temperature adjustment start timing, it is possible to control the pressure loss accurately on the basis of the print data and hence achieve stable ink temperature adjustment, and stable ink supply.

Preferably, the ink temperature adjustment device adjusts the temperature of the ink in such a manner that a product of the viscosity of the ink and a flow velocity of the ink inside the pressure loss region is within a prescribed range.

The product of the ink viscosity and the ink flow velocity is an indicator of the pressure loss, and by controlling this value so that it comes within a prescribed range, it is possible to achieve accurate control of the pressure loss.

Preferably, the ink temperature adjustment device adjusts the temperature of the ink in such a manner that the temperature of the ink inside the inkjet head is higher than the temperature of the ink in the pressure loss region. Thereby, it is possible to stabilize ink temperature adjustment inside the inkjet head and to stabilize discharge characteristics.

Preferably, the ink supply device further comprises a cooling device which is provided in the ink supply channel between the pressure loss region and the inkjet head, and cools the ink therein. Accordingly, although formation of air bubbles in the ink is promoted by the increased temperature, particularly at high printing duty, the air bubbles generated in the ink are caused to dissolve by cooling the ink after it passes through the pressure loss region and hence nozzle blockages can be prevented and stable ink discharge can be achieved.

Alternatively, it is also preferable that the flow rate adjustment device comprises: a pressure control device which controls the flow rate of ink passing through the pressure loss region by controlling a pressure of the ink; an average flow calculation device which calculates an average flow of the ink at the pressure loss region in a prescribed time period; a viscosity estimation device which estimates a viscosity of the ink in the pressure loss region; and a pressure loss calculation device which calculates a pressure loss in the pressure loss region from the calculated average flow of the ink and the estimated viscosity of the ink, wherein the flow rate adjustment device compensates the calculated pressure loss through the pressure control device.

Preferably, the pressure control device includes a pump disposed on the upstream side of the pressure loss region in the ink supply channel.

In this way, by controlling the internal pressure of the ink by means of a pressure control device, such as a pump, it is possible to control the pressure loss in the pressure loss region, and hence stable supply of ink can be achieved by controlling variations in the flow velocity.

As described above, according to the ink supply device for an inkjet printer relating to the present invention, the print data, such as the image data to be recorded (printed) by the inkjet printer, is read out and the ink discharge volume and the printing duty are predicted. The ink flow is then controlled in accordance with the response characteristics at the pressure loss region in such a manner that an ink flow corresponding to the predicted ink discharge volume and printing duty can be supplied to the inkjet head. Therefore, if the printing duty changes, it is possible to ensure a uniform ink discharge volume at all times, and hence the ink discharge characteristics can be stabilized.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, an ink supply device for an inkjet printer according to the present invention is described in detail, with reference to the accompanying drawings.

Figure 1:
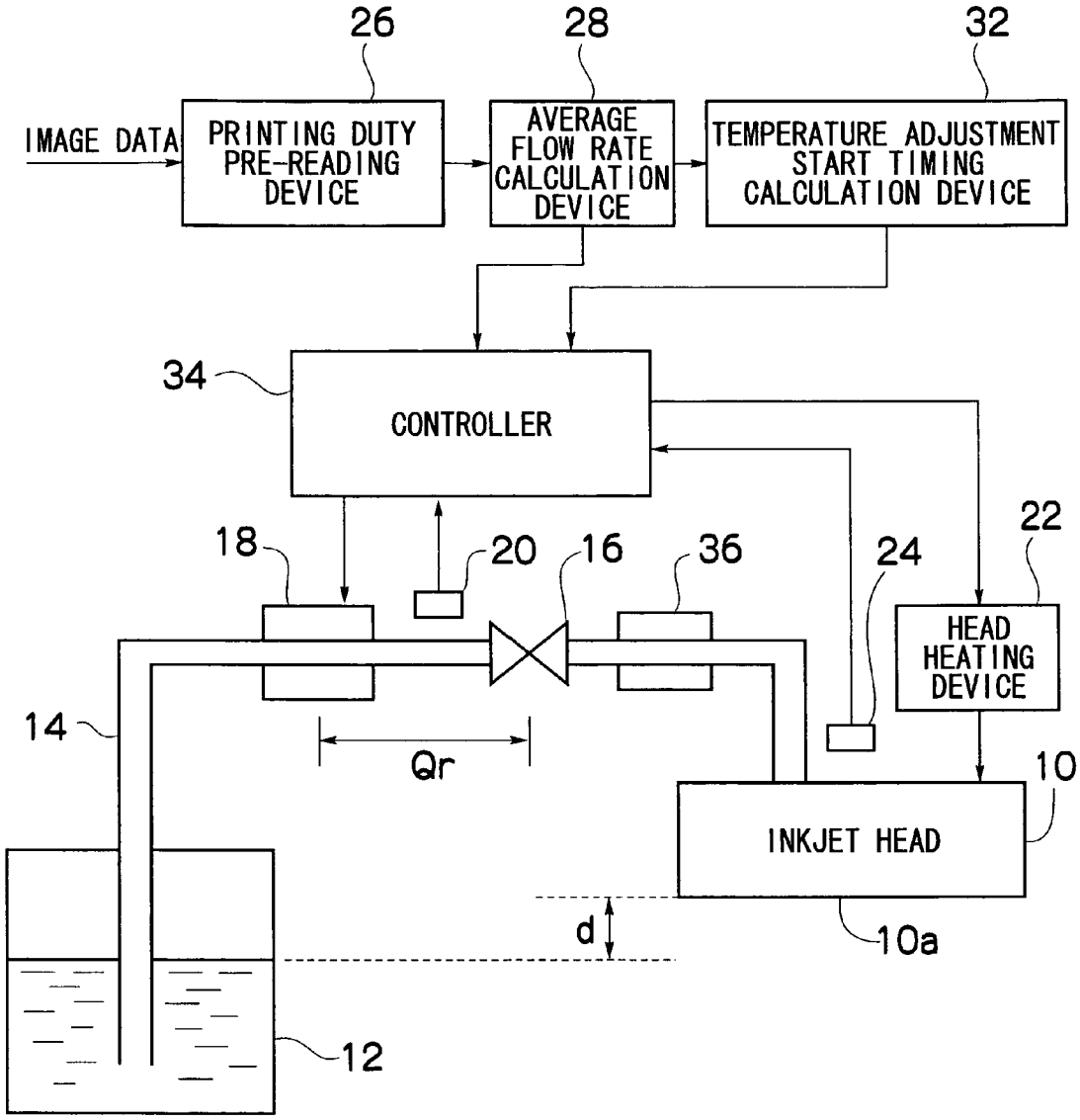
FIG. 1 is a block diagram showing the general composition of an ink supply device for an inkjet printer according to a first embodiment of the present invention.

FIG. 1 is a block diagram showing the general composition of an ink supply device for an inkjet printer according to a first embodiment of the present invention.

As shown in FIG. 1, in basic terms, the ink supply device of the present embodiment supplies ink from an ink tank 12 which stores ink, to an inkjet head 10, via an ink supply channel 14.

A filter 16 for removing foreign matter from the ink is provided in the ink supply channel 14, and a heating supply unit (ink temperature adjustment device) 18 for heating the ink, and a temperature sensor 20, are provided in the vicinity of the filter 16, on the upstream side thereof. Furthermore, a heating device 22 for heating the ink inside the inkjet head 10 and a temperature sensor 24 are also disposed in the inkjet head 10.

Moreover, the ink supply device according to the present embodiment also comprises a printing duty pre-reading device 26, an average flow rate calculation device 28, and a temperature adjustment start timing calculation device 32.

The ink supply device also comprises a control device 34 for controlling the various sections of the ink supply device on the basis of the data calculated by the aforementioned devices, in such a manner that ink is supplied in a stable and appropriate fashion to the inkjet head 10.

Although omitted from the drawings, the inkjet head 10 is formed with a plurality of nozzles which discharge ink, on the lower face (the nozzle surface 10*a*). The ink tank 12 stores ink, and although omitted from the drawings, the interior of the ink tank 12 is open to the atmosphere and assumes atmospheric pressure. By maintaining the height of the surface of the ink accumulated in the tank at a level in the vertical direction that is below the ink surface (meniscus) generated in the nozzles (openings) of the inkjet head 10, the interior of the inkjet head 10 is set to a negative pressure by the level difference, d, and consequently, there is no leaking of ink from the nozzles.

The ink supply channel 14 is connected to the ink tank 12 and the inkjet head 10, and it serves to supply ink to the inkjet head 10. As described above, a filter 16 for removing foreign matter from the ink is provided in the ink supply channel 14. The design of the filter 16 is not limited in particular, and in this example, a mechanical filter is used.

A filter 16 of this kind is necessary in order to remove foreign matter, such as dust or air bubbles, from the ink, but it forms a pressure loss region which produces a resistance to the ink supply and causes loss of pressure in the ink. Furthermore, even in the straight tube sections of the ink supply tubing forming the ink supply channel 14, some pressure loss is generated by the resistance created between the ink and the side walls of the ink supply tubing, due to the viscosity of the ink. Apart from the filter 16, the ink supply channel 14 also contains other pressure loss regions which generate particularly large pressure loss, similarly to the filter 16, for instance, tube sections where the cross-sectional area changes, such as elbows or other bends, or joints in the ink supply tubing, or reduced diameter sections where the diameter of the tubing reduces suddenly.

In the present embodiment, in order to simplify the description, only the filter 16 is identified as a pressure loss region, and control of pressure loss in the filter 16 is described.

The heating supply device 18 is an ink temperature adjustment device which adjusts the viscosity of the ink by heating the ink inside the ink supply channel 14, and has a function as a device for adjusting the ink flow rate passing through, for example, the filter 16 which is the pressure loss region. Furthermore, the temperature sensor 20 determines the temperature of the ink inside the ink supply channel 14.

The heat heating device 22 adjusts the ink viscosity by heating the ink inside the inkjet head 10. The temperature sensor 24 determines the temperature of the ink inside the inkjet head 10.

The printing duty pre-reading device 26 previously reads out, from the image data, the printing duty of printing that is to be performed after a previously established time period (the pre-reading time differential) has elapsed from the printing operation being performed currently (or with reference to the start of printing). Therefore, the number of images to be printed in the image data is confirmed in such a manner that pre-reading is carried out in accordance with the previously established pre-reading time differential. In this way, the printing duty of printing to be performed after the pre-reading time differential is ascertained in advance.

The average flow rate calculation device 28 calculates the average flow of the ink passing through the pressure region, such as the filter 16, within a prescribed time period, from the number of ink discharge operations performed by the nozzles of the inkjet head 10 and the size of the ink particles, as determined on the basis of the image data (print data).

The temperature adjustment start timing calculation device 32 calculates a start timing for temperature adjustment on the basis of the volume of ink from the heating supply device 18 (ink temperature adjustment device) in the ink supply channel 14 to the filter 16 (pressure loss region), the ink flow velocity through the filter 16, and the time interval between discharges.

The temperature adjustment start timing is described in more detail below, but in order that a prescribed flow rate of ink passes through the pressure loss region, namely, the filter 16, in a prescribed time period, it is necessary to adjust the temperature of the ink by heating the ink with the heating supply device 18, in order that the ink passing through the filter 16 assumes a prescribed viscosity. This is particularly important in the case of high-viscosity ink. In this, it is necessary to consider the time required to move a quantity of ink equivalent to the volume of ink present in the ink supply channel 14 between the heating supply device 18 and the filter 16 forming the pressure loss region. The timing at which adjustment of the ink temperature is started prior to discharge, in order to adjust the temperature of the ink discharged to form the relevant image data, is called the temperature adjustment start timing.

In other words, since a delay corresponding to the temperature adjustment start timing elapses between the time at which the ink is heated to a prescribed temperature by means of the heating supply device 18 and the time at which the heated ink passes through the filter 16 (pressure loss region), then the ink is heated by the heating supply device 18, in advance, at a time difference corresponding to this temperature adjustment start timing.

Furthermore, the control device 34 reads in the calculation results from the average flow rate calculation device 28, the temperature adjustment start timing calculation device 32, and the like, and it controls the heating supply device 18, the heat heating device 22, and the various other sections of the ink supply device, on the basis of these results.

For example, the control device 34 controls the heating supply device 18 in such a manner that it starts temperature adjustment of the ink on the basis of the temperature adjustment start timing described above. Thereby, it is possible to compensate for the time lag in the temperature response of the ink supply device, and hence stable ink supply can be achieved.

The control device 34 controls the heating supply device 18 in such a manner that the product of the viscosity of the ink flowing through the filter 16 forming the pressure loss region, and the ink flow velocity comes within a prescribed allowable range. (As described below, the product of the ink viscosity and the ink flow velocity is equivalent to the pressure loss). Moreover, the control device 34 controls the heating supply device 18 and the head heating device 22 in such a manner that the adjustment temperature $T_2$ of the ink inside the inkjet head 10 as controlled by the head heating device 22 is higher than the adjustment temperature $T_1$ of the ink inside the pressure loss region (filter 16) as controlled by the heating supply device 18.

In this way, the ink supply device according to the present embodiment takes the filter 16 as an example of a pressure loss region in the ink supply channel 14, and by adjusting the ink temperature and hence controlling the ink viscosity in such a manner that the ink passing through the filter 16 forming this pressure loss region is a prescribed flow rate, it is possible to control the flow of the ink in such a manner that a stable ink supply is achieved, even in the case of high-viscosity ink.

Furthermore, as shown in FIG. 1, the ink supply device may also comprise a cooling device 36 which cools the ink, provided between the filter 16 (pressure loss region) in the ink supply channel 14 and the inkjet head 10. This is desirable because generation of air bubbles inside the ink is promoted when the ink temperature is raised during high-duty printing, and therefore, if the ink is cooled after passing through the filter 16, which is the pressure loss region, the amount of oxygen dissolved inside the ink will increase, the air bubbles will be dissolved, and hence blocking of nozzles due to the air bubbles is prevented.

As stated previously, apart from the filter 16, there are various other pressure loss regions in the ink supply channel 14, such as elbows, or the like, and it is possible to control the pressure loss at this plurality of pressure loss regions simultaneously, thereby also controlling the ink flow at these points, simultaneously.

Figure 2:
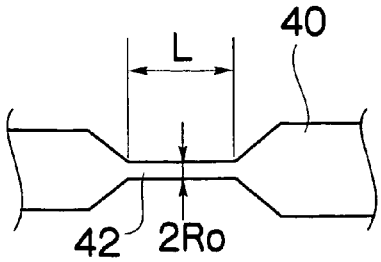
FIG. 2 is an illustrative diagram showing an example of a pressure loss region for indicating a method of calculating the pressure loss.

There follows a brief description of pressure loss occurring in a pressure loss region of a fluid supply path. FIG. 2 shows an example of a pressure loss region. In the example shown in FIG. 2, a portion of the fluid supply tube 40 is formed into a narrow tube section 42, and this portion forms the pressure loss region. The length of the narrow tube section 42 forming the pressure loss region is taken to be L and the equivalent radius of the pressure loss region is taken to be $R_0$.

Furthermore, taking the flow rate of the fluid passing through this pressure loss region (narrow tube section 42) in a prescribed time t to be $Q_t$, and the viscosity of the fluid to be μ, the pressure loss ΔP in the pressure loss region is expressed by the following Formula (1):

$$\Delta P=(8Q_t\mu L)/(\pi R_0^4 t). \quad (1)$$

Furthermore, the flow velocity of the fluid in the pressure loss region, V, is expressed by the following Formula (2):

$$V=Q_t/(t\pi R_0^2). \quad (2)$$

According to Formula (1) and Formula (2), the pressure loss ΔP is expressed by the following Formula (3):

$$\Delta P=(8L/R_0^2)\times V\times\mu. \quad (3)$$

Here, it can be seen that the length L of the narrow tube section 42 (pressure loss region) and the equivalent radius $R_0$ of the pressure loss region are parameters relating to the dimensions and shape of the pressure loss region, and the pressure loss ΔP is determined by the product of the flow velocity V in the pressure loss region, and the viscosity μ of the fluid (V×μ). Therefore, the product (V×μ) of the flow velocity V in the pressure loss region and the viscosity μ can be regarded as being equivalent to the pressure loss. Moreover, taking the prescribed time t as unit time, the flow rate $Q_t$ per unit time is the same as the product of the flow velocity V and the cross-sectional area, and as can be seen from Formula (1), the pressure loss ΔP is dependent on the product of the flow rate of the fluid $Q_t$ in the pressure loss region and the viscosity μ of the fluid.

Figure 3:
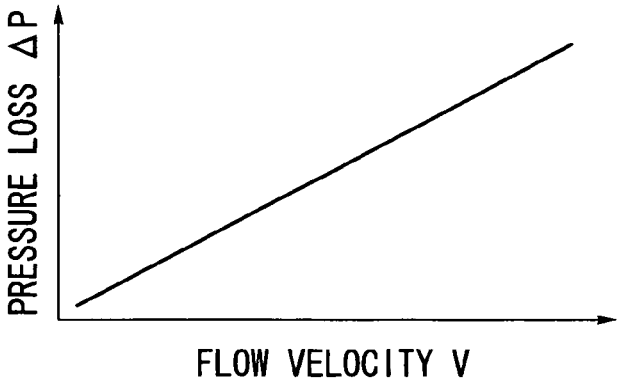
FIG. 3 is a graph showing the relationship between pressure loss and ink flow velocity.

FIG. 3 shows the relationship between the flow velocity V of a fluid and the pressure loss, ΔP, in the case of a Newtonian fluid of uniform viscosity. As can be seen from Formula (3), if the viscosity μ of the fluid is uniform, then the pressure loss ΔP is directly proportional to the flow velocity V of the fluid. The graph shown in FIG. 3 shows a case where the viscosity of the fluid μ is uniform, but if the viscosity μ changes, the gradient of the straight line shown in FIG. 3 changes accordingly.

Figure 4:
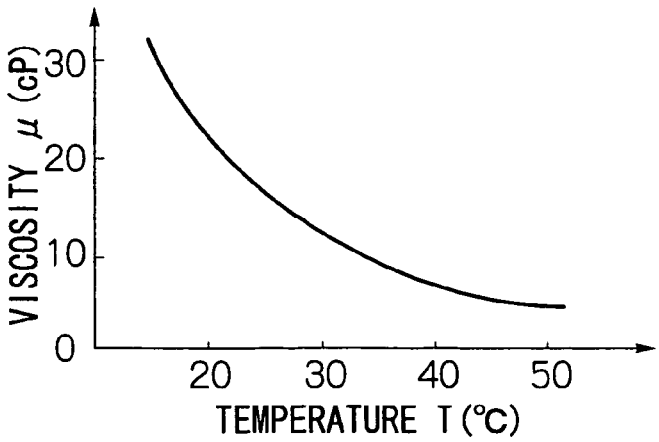
FIG. 4 is a graph showing the relationship between ink viscosity and ink temperature.

Furthermore, the viscosity μ of the fluid depends on the temperature T of the fluid. In other words, the relationship μ=f(T) is established between the fluid viscosity μ and the fluid temperature T. FIG. 4 shows the relationship between the temperature T and the viscosity μ of the fluid. In this way, the viscosity of the fluid declines as the temperature of the fluid increases.

Therefore, as can be seen from Formula (3), if the pressure loss is to be reduced, then the viscosity μ of the fluid should be reduced. Moreover, it can also be seen that, in order to reduce the viscosity μ, the temperature T of the fluid should be raised. The aforementioned properties of a fluid with respect to pressure loss are also established in the case of the ink in the present embodiment, and especially, high-viscosity ink.

Below, the action of the present embodiment is described with reference to FIG. 5.

Figure 5:
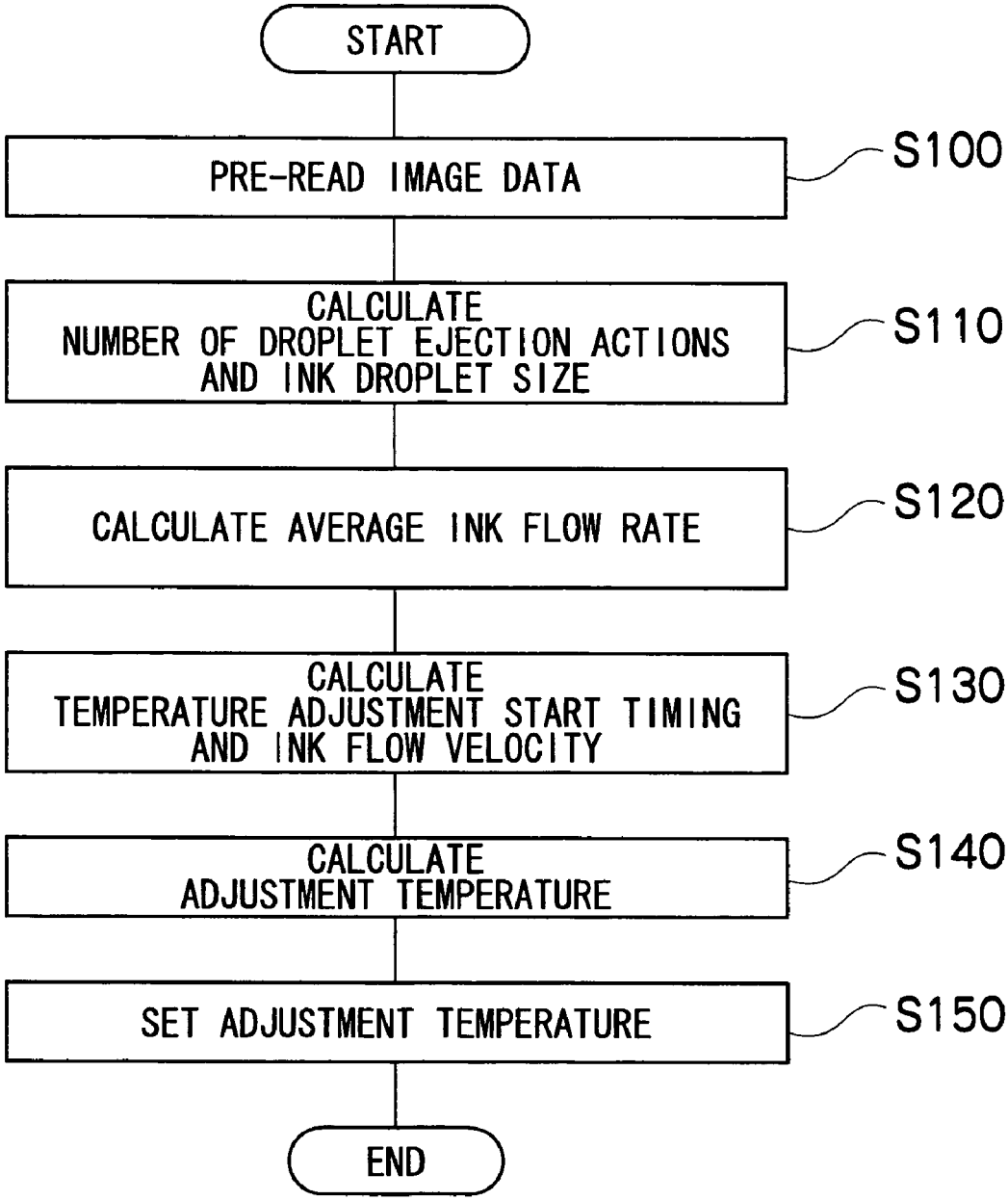
FIG. 5 is a flowchart illustrating the action of the first embodiment.

Firstly, at step S100 in FIG. 5, the image data to be printed is read in to the printing duty pre-reading device 26 and it is converted into CMYK droplet ejection data for discharging ink corresponding to the image data from the nozzles of the inkjet head 10. In this way, ink discharge data for printing is established.

At the next step S110, the printing duty pre-reading device 26 calculates the number of ink droplet discharge actions and the ink droplet size, and it calculates the printing duty, namely, the number of ink droplet discharge actions per unit time. This printing duty is the ratio of the required ink consumption for each respective color as calculated from the CMYK droplet ejection data, with respect to the maximum ink supply volume that can be supplied from the supply flow channel (including the pressure loss region, namely, the filter) to the head per unit time, per color.

In the next step S120, the printing duty pre-reading device 26 pre-reads, from the image data, the printing duty of the printing to be carried out after a previously established time period (after the pre-reading time differential=$t_2$) from the printing operation currently being carried out (or with reference to the start of printing), and the average flow rate calculation device 28 calculates the average flow rate $Q_n$ of the ink in a prescribed time period $t_1$ after the pre-reading time differential $t_2$.

This data is sent to the average flow rate calculation device 28, which calculates the average ink flow rate $Q_n$ for the prescribed time $t_1$.

Here, the "prescribed time $t_1$" is an arbitrary minimum time period, the average flow rate of the ink, $Q_i$, is the average flow indicating the amount of ink discharged from the inkjet head 10 during the minimum time period $t_1$.

Figure 6:
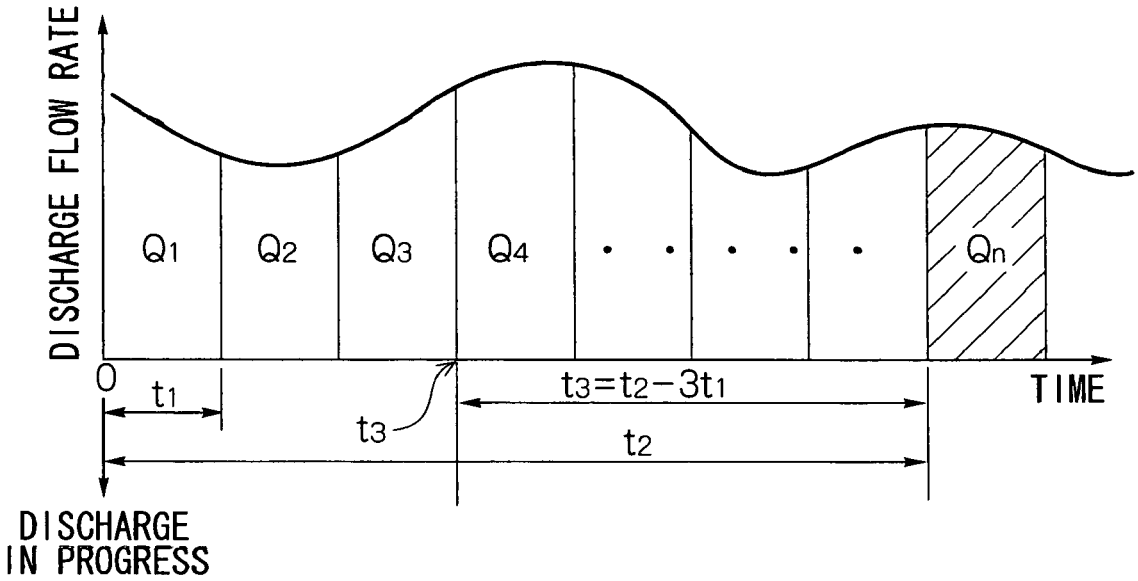
FIG. 6 is a graph showing the relationship between discharge volume and time.

FIG. 6 shows the relationship between the time period and the discharge flow rate. The graph in FIG. 6 shows time on the horizontal axis and discharge flow rate on the vertical axis, and it depicts a case where time 0 is during a current ink discharge. Ink of a volume corresponding to $Q_1$ is discharged between the current time and time $t_1$. The flow rate of the ink for printing the currently verified image data is $Q_n$, and this ink volume is discharged after time $t_2$.

Next, at step S130, the temperature adjustment start timing calculation device 32 calculates the temperature adjustment start timing $t_3$ on the basis of the ink volume $Q_r$ between the heating supply device 18 and the filter 16 (the pressure loss region) in the ink supply channel 14 (see FIG. 1), the average ink flow rate $Q_n$, and the pre-reading time differential $t_2$. The ink volume $Q_r$ is determined previously on the basis of the inkjet printer settings.

As described above, this temperature adjustment start timing $t_3$ indicates the timing at which temperature adjustment is started prior to discharge, in order that the ink for printing the relevant image data can pass through the pressure loss region at a suitable flow rate. This temperature adjustment start timing is calculated in the following manner.

For example, if the sum of the average ink flow rates $Q_1$, $Q_2$, $Q_3$ during the respective time periods of $t_1$, as shown in FIG. 6, is equal to the ink volume $Q_r$ between the heating supply device 18 and the filter 16 (pressure loss region) (namely, if $Q_r=Q_1+Q_2+Q_3$), then the time period required for the ink currently situated at the heating supply device 18 to reach the filter 16 (pressure loss region), (namely, the temperature adjustment delay time) $t_4$, corresponds to 3 $t_1$. Therefore, heating (temperature adjustment) of the ink that is to be discharged after a time period of $t_2$ must be started after a time period of $t_2-3t_1$. Consequently, the temperature adjustment start timing $t_3$ indicating the timing to start temperature adjustment will be $t_3=t_2-3t_1$.

In a general case, if the temperature adjustment delay time at which the ink at the heating supply section reaches the filter (pressure loss region) is taken to be $t_4$, then the temperature adjustment start timing $t_3$ corresponding to the average flow of ink, $Q_n$, that is to be discharged after the pre-reading time $t_2$ is set to be $t_3=t_2-t_4$. The temperature adjustment delay time $t_4$ depends on conditions such as the ink volume $Q_r$ between the heating supply section and the filter (pressure loss region), and the thermal capacity of the ink, and the like.

Furthermore, in a case where ink having an average flow rate of $Q_n$ passes through the filter 16 (pressure loss region) during time $t_1$, the ink flow velocity V is obtained by dividing this average ink flow rate, $Q_n$, by the time $t_1$ and the cross-sectional area of the pressure loss region. If the equivalent radius of the filter 16, which is the pressure loss region, is taken to be $R_0$, then the flow velocity, V, of the ink passing through the filter 16 (pressure loss region) is determined on the basis of Formula (2), to be $V=Q_n/(t_1\times\pi R_0^2)$.

The temperature adjustment start timing $t_3$ calculated by the temperature adjustment start timing calculation device 32, and the ink flow velocity V at the filter 16 (pressure loss region) are supplied to the control device 34. The control device 34 calculates the adjustment temperature on the basis of the received data, and by controlling the heating supply device 18, (ink temperature adjustment device) at the temperature adjustment start timing $t_3$, then the flow rate of the ink passing through the filter 16, which is the pressure loss region, is stabilized.

More specifically, firstly, at step S140, the adjustment temperature $T_1$ is calculated. In this case, the ink temperature (adjustment temperature $T_1$) is set, thereby controlling the viscosity, in such a manner that the pressure loss ΔP between the upstream side and the downstream side of the filter 16 (pressure loss region) comes within a prescribed allowable range. Desirably, the allowable range is a range whereby the ink particles discharged onto the recording medium are within ±30% or less of their target size, for example. In this case, the allowable range for the pressure loss ΔP is within −5% of the internal pressure of the supply section when in a static state, and hence the pressure loss ΔP should be controlled so as to come within this range.

As stated previously, the relationship indicated in Formula (3) is established between the ink flow velocity V, the ink viscosity μ and the pressure loss ΔP. Therefore, the ink viscosity μ (or accurately speaking, the range thereof) at which the pressure loss ΔP comes within the prescribed allowable range is found on the basis of the ink flow velocity V calculated above.

Next, an adjustment temperature $T_1$ forming a control target temperature is calculated from the ink viscosity μ thus derived, on the basis of a table which indicates the relationship between the viscosity and temperature as illustrated in FIG. 4 described above.

At step S150, the control device 34 sets the calculated adjustment temperature $T_1$ at the heating supply device 18 forming the ink temperature adjustment device, and at the timing corresponding to the temperature adjustment start timing $t_3$, the temperature of the ink is adjusted.

In this way, the ink viscosity is controlled by setting the temperature to the adjustment temperature $T_1$ calculated as described above, and hence the pressure loss is made to come within the prescribed allowable range. As a result of this, the flow rate of the ink passing through the filter 16, which is the pressure loss region, is controlled suitably and stable ink supply is possible, even in the case of high-viscosity ink.

Furthermore, in this case, as stated previously, the product of the ink flow velocity V and the ink viscosity μ, namely, V×μ, is equivalent to the pressure loss ΔP, and therefore, instead of controlling the pressure loss ΔP to within a prescribed allowable range, it is also possible to control temperature adjustment of the ink in such a manner that the product of the ink velocity V, and the ink viscosity μ, namely, V×μ, comes within a prescribed allowable range.

Moreover, the ink inside the inkjet head 10 is controlled to an adjustment temperature $T_2$ in a range which keeps the ink in a suitable state for discharge, by means of the head heating device 22. The adjustment temperature $T_2$ of the ink inside the inkjet head 10 is desirably set to be higher than the adjustment temperature $T_1$ in the pressure loss region, in order to ensure stable temperature adjustment of the ink inside the head and stable discharge characteristics. Moreover, more desirably, the adjustment temperature $T_2$ of the ink inside the head is controlled to as to be a uniform temperature.

Next, a second embodiment of the present invention will be described.

Figure 7A:
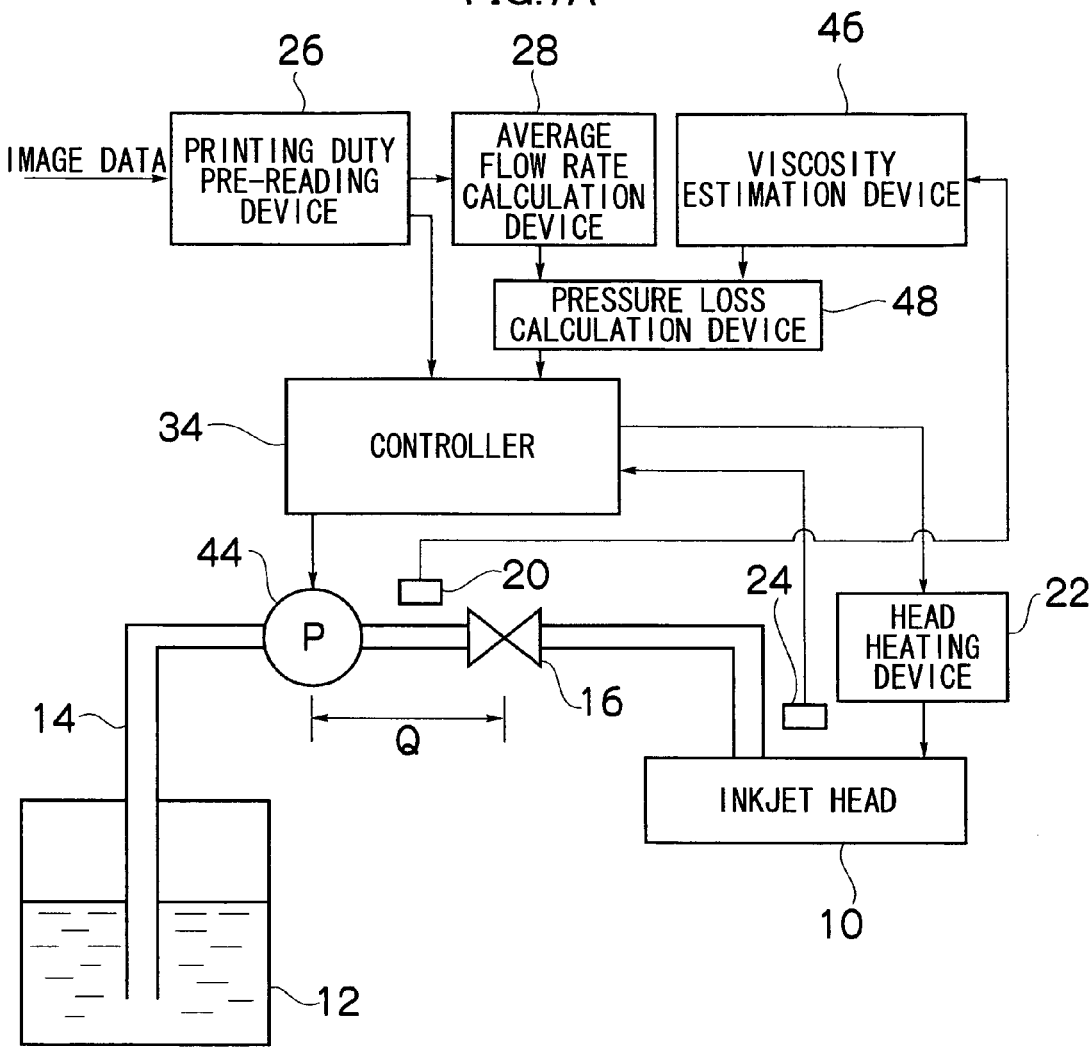
FIGS. 7A and 7B are block diagrams showing the general composition of an ink supply device for an inkjet printer according to a second embodiment of the present invention.

FIG. 7A is a block diagram showing the general composition of an ink supply device for an inkjet printer according to a second embodiment of the present invention.

In the present embodiment, the ink flow rate is adjusted by controlling the pressure loss in the pressure loss region through controlling the ink pressure directly.

For this purpose, the ink supply device according to the present embodiment comprises a pump forming a pressure control device which controls the ink flow rate by controlling the pressure loss. More specifically, as shown in FIG. 7A, in the ink supply device according to the present embodiment, a pump 44 is disposed on the upstream side of a filter 16 forming the pressure loss region, in an ink supply channel 14 connecting an ink tank 12 to an inkjet head 10.

Furthermore, similarly to the ink supply device of the first embodiment described above, the ink supply device of the present embodiment comprises a temperature sensor 20 for determining the ink temperature in the region of the filter 16, a head heating device 22 for adjusting the temperature of the ink inside the head to a suitable range in order to maintain discharge properties, a temperature sensor 24 for determining the temperature of the ink inside the head, a printing duty pre-reading device 26, an average flow rate calculation device 28 and a control device 34.

Apart from this, the ink supply device according to the present embodiment also comprises an ink viscosity estimation device 46 for estimating the viscosity of the ink in the vicinity of the filter 16 forming the pressure loss region, from the ink temperature determined by the temperature sensor 20, and a pressure loss calculation device 48 for calculating the pressure loss in the pressure loss region. The temperature sensor 20 is disposed between the pump 44 and the filter 16 (pressure loss region).

The viscosity estimation device 46 estimates the ink viscosity in the pressure loss region from the ink temperature determined by the temperature sensor 20, by using a table indicating the relationship between viscosity and temperature as illustrated in FIG. 4.

The pressure loss calculation device 48 calculates the pressure loss in the pressure loss region from the average ink flow rate and the ink viscosity. Furthermore, the control device 34 according to the present embodiment controls the flow rate of the ink passing through the pressure loss region by controlling the internal pressure of the ink, through controlling the pump 44 (pressure control device), on the basis of the calculated pressure loss.

The other constituent elements of the present embodiment are the same as those of the first embodiment described above, and hence they are labeled with the same reference numerals and detailed description thereof is omitted here.

Figure 7B:
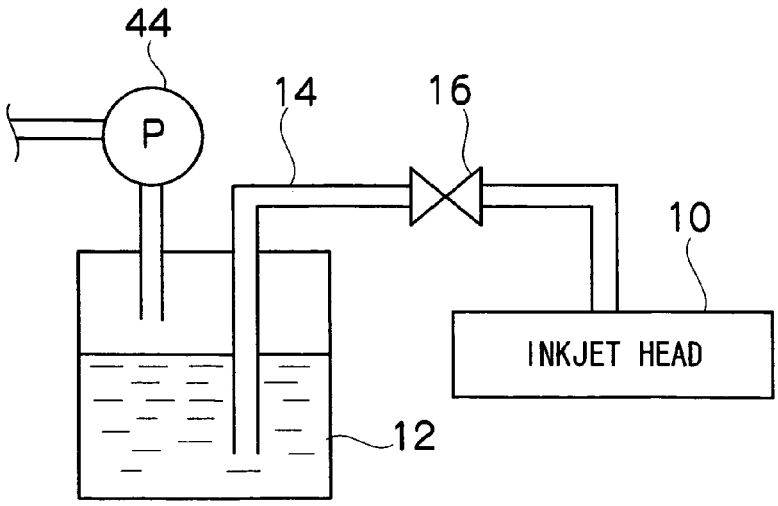

FIG. 7B shows a further example of the present embodiment. In the example shown in FIG. 7A, the pump 44 is disposed in the ink supply channel 14 and therefore the pressure loss is corrected after the pump 44. However, in the example shown in FIG. 7B, the pump 44 is disposed on the upstream side of the ink tank 12, and hence the pressure in the whole supply system form the ink tank 12 to the inkjet head 10 can be corrected by taking the whole supply system as a pressure loss system. In the example shown in FIG. 7B, apart from the position of the pump 44, the composition is the same as that in FIG. 7A and is therefore omitted from the drawing.

Below, the action of the present embodiment will be described.

Figure 8:
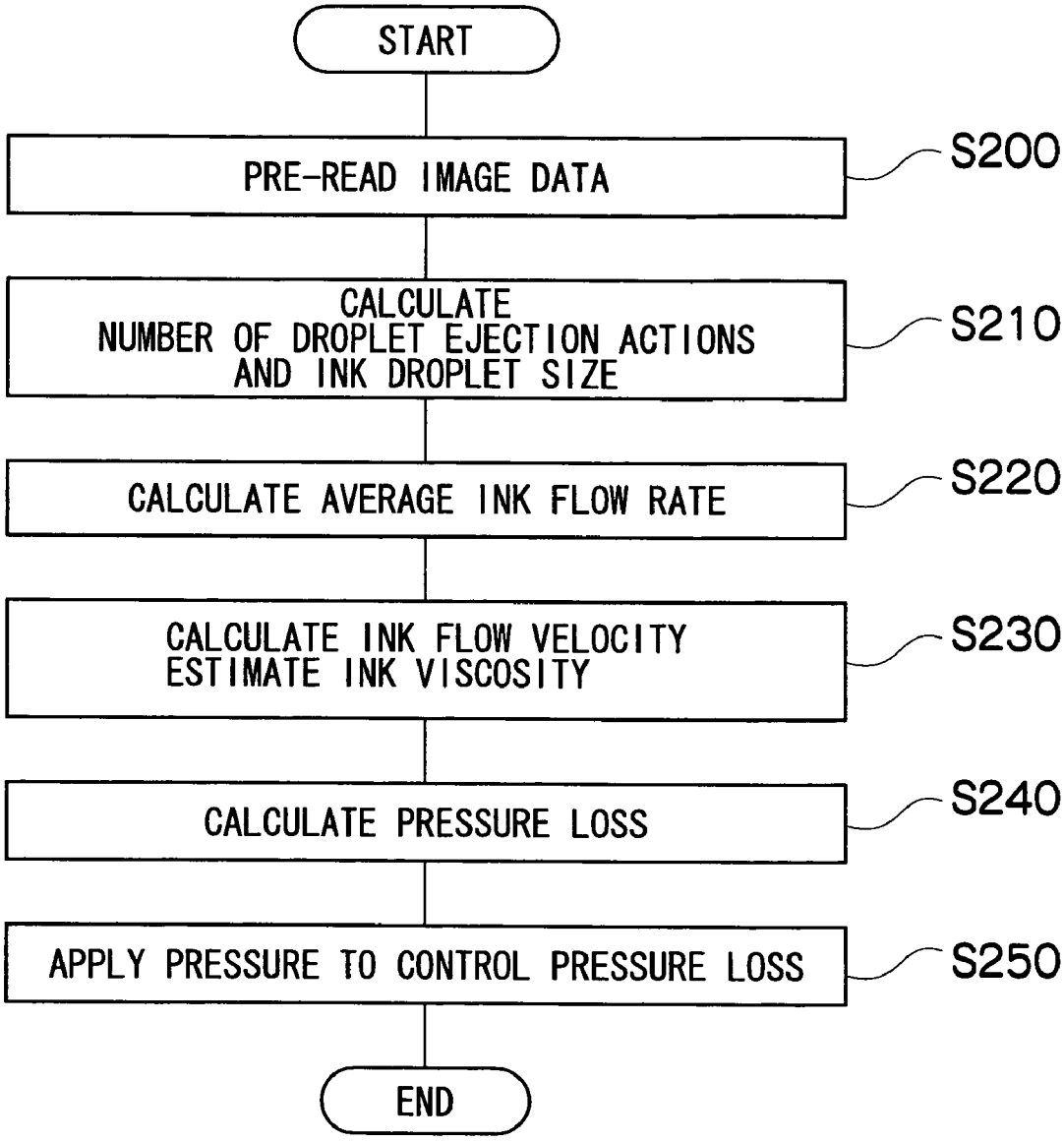
FIG. 8 is a flowchart illustrating the action of the second embodiment.

FIG. 8 is a flowchart illustrating the action of the present embodiment.

Step S200 to step S220 in FIG. 8 are similar to step S100 to step S120 in FIG. 5 which indicate the action of the first embodiment.

More specifically, at step S200 in FIG. 8, the image data is read in by the printing duty pre-reading device 26 on the basis of the previously established pre-read time differential $t_2$, the image data is verified, and at step S210, the number of ink droplets to be discharged, the ink droplet size, and the printing duty, are calculated. At step S220, the average ink flow rate $Q_n$ in the prescribed time $t_1$ is calculated by the average flow rate calculation device 28.

Next, at step S230, the ink flow velocity in the pressure loss region is calculated and the ink viscosity is estimated. The pressure loss calculation device 48 calculates the ink flow velocity in the pressure loss region from the average ink flow rate $Q_n$, on the basis of Formula (2), similarly to the first embodiment described above. More specifically, the ink flow velocity V is determined by dividing the average ink flow rate $Q_n$ by the time period $t_1$, and the cross-sectional area of the filter 16 (pressure loss region). Taking the equivalent radius of the filter 16 to be $R_0$, the ink flow velocity V in the pressure loss region is calculated by Formula (2)$V=Q_n/(t_1\times\pi R_0^2)$.

Furthermore, the viscosity estimation device 46 estimates the ink viscosity on the basis of the ink temperature in the vicinity of the pressure loss region as determined by the temperature sensor 20, by using a table indicating the relationship between the viscosity and the temperature as illustrated in FIG. 4.

Next, at step S240, the pressure loss calculation device 48 calculates the pressure loss $\Delta P$ in the pressure loss region, on the basis of the calculated ink flow velocity V and the estimated ink viscosity $\mu$. More specifically, the pressure loss calculation device 48 calculates the pressure loss $\Delta P$ from the ink flow velocity V and the ink viscosity $\mu$, by means of Formula (3) above, $\Delta P=(8L/R_0^2)\times V\times\mu$.

Finally, at step S250, after the pre-reading time differential $t_2$ has elapsed, the control device 34 applies pressure to the ink inside the ink supply channel 14 by driving the pump 44 in order to control the pressure loss $\Delta P$, on the basis of the pressure loss $\Delta P$ required to obtain the average ink flow rate $Q_n$ calculated as described above.

Thereby, the pressure loss $\Delta P$ is controlled directly by controlling the internal pressure of the ink by means of the pump 44, and even in the case of high-viscosity ink, it is possible to adjust the ink flow in the pressure loss region to a suitable flow rate, and hence stable ink supply can be achieved.

In the method for controlling pressure loss in the ink at a pressure loss region of an ink supply path described above, the printing duty is read in previously from the image data, and the pressure loss between the upstream side and the downstream side of the pressure loss region is controlled to within a prescribed allowable range, on the basis of the ink flow rate and ink flow velocity calculated from this printing duty. Furthermore, in the method for controlling the internal pressure on the upstream side of the pressure loss region, similarly, the image data is read in previously and the pressure on the downstream side of the pressure loss region is controlled to within a prescribed allowable range.

Furthermore, in both of the embodiments, in order to simplify the description, a filter 16 is taken as an example of a pressure loss region in the ink supply channel 14, and control of pressure loss at the filter 16 is described. However, an ink supply channel 14 has other pressure loss regions in addition to the filter 16, such as elbows, joints, or the like, and pressure losses occur respectively at each of these regions.

Therefore, in a system composition for simultaneously controlling pressure loss in a plurality of pressure loss regions, the respective pressure losses at the plurality of pressure loss regions can be calculated simultaneously, and these pressure losses at the respective pressure loss regions can be controlled simultaneously so as to come within respective allowable ranges.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ink supply device for an inkjet printer which supplies ink to an inkjet head via an ink supply channel from an ink tank storing ink, the ink supply device comprising:

a printing duty pre-reading device which previously reads a printing duty from print data;

an average flow calculation device which calculates an average flow of the ink passing through a pressure loss region in the ink supply channel in a prescribed minimum time period after a pre-reading time differential set in the printing duty pre-reading device, from the printing duty read by the printing duty pre-reading device; and a flow rate adjustment device which is provided on an upstream side of the pressure loss region in the ink supply channel and controls a flow rate of the ink passing through the pressure loss region in the ink supply channel to a prescribed flow rate, continuously with respect to the printing duty, in accordance with the average flow of the ink passing through the pressure loss region in the ink supply channel in the prescribed minimum time period calculated by the average flow calculation device.

2. The ink supply device as defined in claim 1, wherein the flow rate adjustment device comprises:

an ink temperature adjustment device which controls the flow rate of the ink passing through the pressure loss region by adjusting temperature of the ink and thereby adjusting a viscosity of the ink;

a temperature adjustment start timing calculation device which calculates a transmit time of the ink between the ink temperature adjustment device and the pressure loss region and calculates a temperature adjustment start timing, according to the pre-reading time differential set in the printing duty pre-reading device, volume of the ink between the ink temperature adjustment device and the pressure loss region in the ink supply channel, and the average flow of the ink in the pressure loss region; and a device which controls a temperature adjustment start timing to compensate temperature adjustment start timings for the ink between the ink temperature adjustment device and the pressure loss region.

3. The ink supply device as defined in claim 2, wherein the ink temperature adjustment device adjusts the temperature of the ink in such a manner that a product of the viscosity of the ink and a flow velocity of the ink inside the pressure loss region in the prescribed minimum time period is within a prescribed range.

4. The ink supply device as defined in claim 2, wherein the ink temperature adjustment device adjusts the temperature of the ink in such a manner that the temperature of the ink inside the inkjet head is higher than the temperature of the ink in the pressure loss region.

5. The ink supply device as defined in claim 2, further comprising a cooling device which is provided in the ink supply channel between the pressure loss region and the inkjet head, and cools the ink therein.

* * * * *